United States Patent [19]

Weller, Jr.

[11] 4,040,243

[45] Aug. 9, 1977

[54] ELECTRODES FOR ELECTROSTATIC FIBER COLLECTING AND SPINNING APPARATUS

[75] Inventor: Heber W. Weller, Jr., Metairie, La.

[73] Assignee: The United States of America as represented by the Secretary of Agriculture, Washington, D.C.

[21] Appl. No.: 706,978

[22] Filed: July 19, 1976

[51] Int. Cl.[2] ..... D01H 1/12

[52] U.S. Cl. ..... 57/58.89; 57/58.95

[58] Field of Search ..... 57/58.89–58.95

[56] References Cited

U.S. PATENT DOCUMENTS

| | | | |
|---|---|---|---|
| 3,696,600 | 10/1972 | Mayer, Jr. et al. | 57/58.95 X |
| 3,696,603 | 10/1972 | Kotter et al. | 57/58.89 |
| 3,768,243 | 10/1973 | Brown et al. | 57/58.89 |
| 3,901,012 | 8/1975 | Safar | 57/58.89 |

*Primary Examiner*—John Petrakes

*Attorney, Agent, or Firm*—M. Howard Silverstein; David G. McConnell; Salvador J. Cangemi

[57] ABSTRACT

An electrostatic fiber collecting and yarn spinning apparatus is substantially improved by adding a bowl-shaped electrode and changing the configuration of the electrodes so that the rotating electrode is substantially enclosed by the stationary electrode.

9 Claims, 8 Drawing Figures

ELECTRODES FOR ELECTROSTATIC FIBER COLLECTING AND SPINNING APPARATUS

BACKGROUND OF THE INVENTION

1. Field of the Invention

This invention relates to an improvement on electrostatic fiber collecting and spinning machinery. More specifically, this invention improves the performance of apparatus of the known art by changing the configuration of the cone-shaped electrode element and enclosing it in a bowl-shaped electrode of specific design. With the improved electrode system all fibers are collected rather than merely a substantial portion of the opened fibers in a continuous yarn-forming operation.

2. Description of the Prior Art

Kotter and Salaun in their U.S. Pat. No. 3,696,603, granted Oct. 10, 1972, disclose an apparatus wherein "by combination and interaction of electrostatic and mechanical forces, airborne opened fibers are transported, parallelized, collected en masse and twisted to continuously form a high quality textile yarn."

The design of the Kotter and Salaun apparatus has the disadvantage that, under some operating conditions, part of the fibers escape from the apparatus and are lost from the process resulting in fiber waste, a non-uniform product, and increased cleaning requirements and unsatisfactory working conditions due to fibers drifting in the atmosphere.

SUMMARY OF THE INVENTION

The disadvantages of the Kotter and Salaun apparatus are overcome by redesigning certain components. In the apparatus of the present invention opened textile fibers are injected into a high voltage electrical field formed and sustained by two electrodes, one of which is composed of two components, a spindle (with a non-conducting twisting element) and another electrically conducting element, both separately revolving at controlled different speeds about a common axis. The other electrode is stationary and shaped similar to a bowl. It is positioned so that it substantially encloses the elements of the revolving electrode and is provided with an opening extending axially therethrough from which the newly formed yarn is withdrawn from the spindle.

Upon entering the electrical field, the fibers become aligned parallel to the lines of force produced by the electrical potential difference (i.e., 10 kv. to 60 kv.). By a unique combination and interaction of electric field and mechanical forces the parallelized fibers are rapidly transported to the centrally located relatively faster revolving spindle onto which a non-conducting twisting element is centrally attached. The speed at which the fibers move inwardly to the spindle projection is dependent on the rotational speed of the revolving electrode and the angle (or rate) of convergence between the electrodes toward the common axis.

The maximum electrical field strength is between the conducting, circular knife-edge of the spindle and the bowl-shaped electrode. Because of its position and shape, the knife edge collects and holds the fibers in a circular array momentarily, as the yarn is being formed. The non-conducting spindle projection serves as a stable base upon which the incoming fibers orderly consolidate, and also as the twisting means for forming the fibers into yarn.

The size of the yarn produced is controlled by the rate at which the fibers are introduced into the electrical field and the rate at which the yarn is withdrawn through the opening of the stationary electrode.

The spindle rotational speed is governed only be mechanical limitations, providing a means for achieving extremely high production rates.

The main object of the present invention is to improve on the performance of the apparatus of U.S. Pat. No. 3,696,603.

DESCRIPTION OF THE PREFERRED EMBODIMENTS

To illustrate the preferred embodiments of the present invention, which is the electrode system, the following drawings are presented; however, these are not meant to be limits to the invention.

Figure 1:
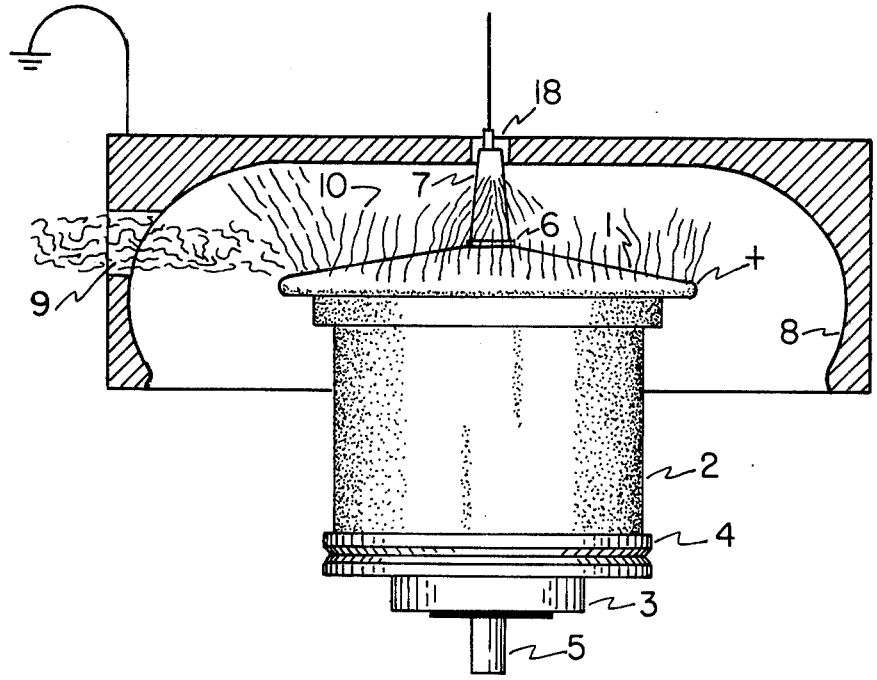
FIG. 1 is a schematic elevation view, showing the bowl-shaped electrode in cross-section and illustrating the general alignment of the fibers within the field.

FIG. 1 illustrates the electrode portion of the apparatus wherein electrode element 1 is rigidly attached to cylinder 2, which is rotatably mounted, axially and radially supported through suitable bearings by column 3, and independently rotated by a variable speed electric motor (not shown) to which it is coupled by means of an electrically non-conducting V belt (not shown) driving pulley 4.

Spindle 5 is constructed with a conducting knife edge ring 6 which extends axially through an opening in the center of electrode element 1, terminating slightly above its surface and comprising the second element of the revolving electrode. Spindle 5 is rotatably mounted, axially and radially supported through suitable bearings, by column 3, and independently rotated by a variable speed electric motor (not shown).

Attached to and extending axially from spindle 5 is electrically non-conducting twisting element 7.

Stationary electrode 8 is bowl-shaped and is rigidly attached in an upside-down position so that its axis coincides with the axis of the revolving electrode elements 1 and 6, and the twisting element 7. Electrode 8 is represented in this Figure by a cross-section view through and parallel with the axis of the electrodes. An opening 9 through the side of electrode 8 is provided to permit injection of fibers 10 in a radial direction. Electrode 8 is also provided with an opening 18 axially aligned with twisting element 7. The inner surface of stationary electrode 8 is circular with respect to the axis of electrode elements 1 and 6 and twisting element 7, and is designed so that the distance between it and the surface of electrode element 1 is continuously increasing in a radial direction from the axis, and is designed so that it substantially encloses electrode element 1 by extending below the side of element 1. The side of element 1 is defined as the plane at which its diameter is greatest. The perimeter of element 1 is curved radially to eliminate sharp edges that would cause anomalies in the electrical field.

Electrode element 1 is energized by a high voltage power supply (not shown) from which the electrical charge is conducted by conventional wire and slide contacting means to cylinder 2 and thence to element 1. Electrode element 6 is also energized by the electrical charge being conducted through supporting bearings and column 3 from cylinder 2. Stationary electrode 8 is grounded.

Figure 2:
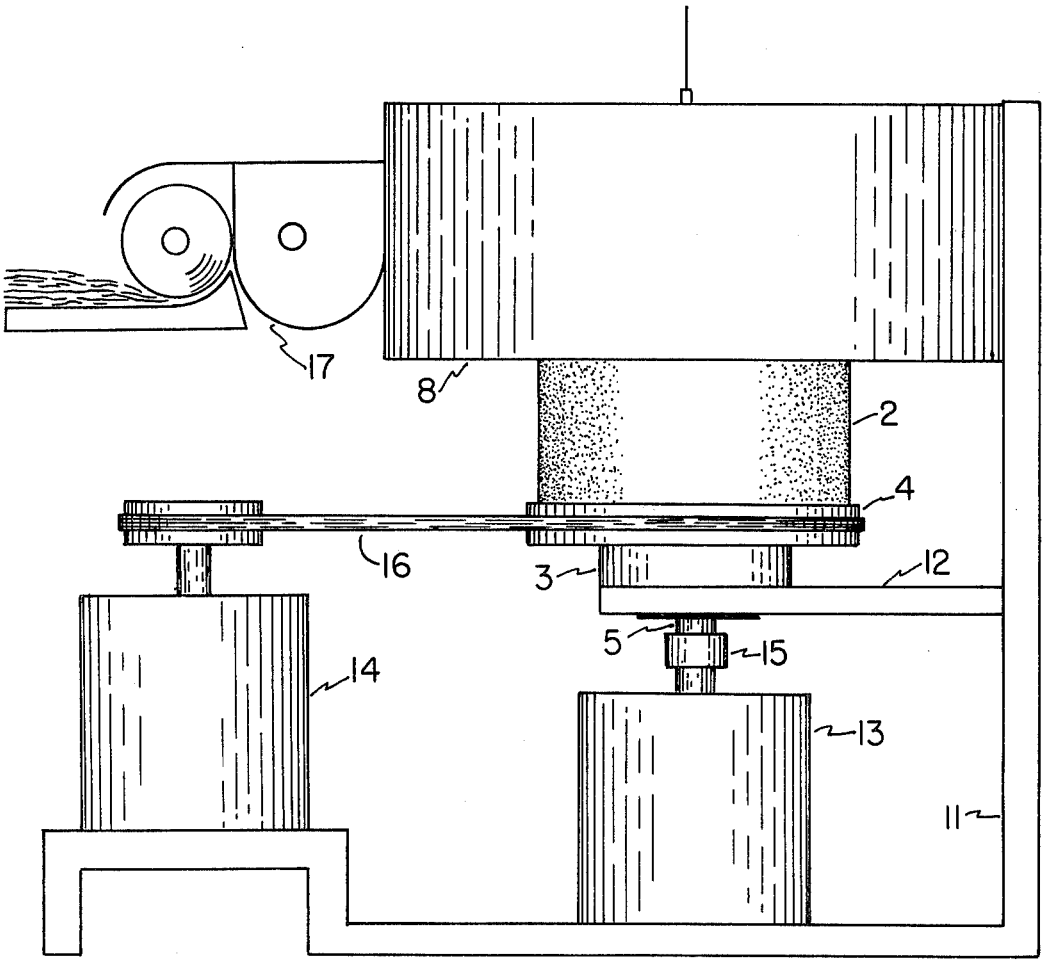
FIG. 2 is a schematic elevation view, showing the external appearance of the assembled unit containing the electrode as well as the driving means, and surrounding components.

FIG. 2 schematically illustrates the assembled apparatus which contains the pertinent parts, including the driving means, motor coupling means, and a supporting frame, as well as a fiber opening and feeding means. The literature provides suitable means for supplying cotton fibers to the apparatus of FIG. 2 (see U.S. Pat. No. 3,685,100).

With reference to both FIGS. 1 and 2, the column 3, supporting revolving electrode elements 1 and 6, is rigidly atttached to frame 11 by an electrically non-conducting support 12. Stationary electrode 8 and variable speed electric motors 13 and 14 are rigidly attached to frame 11. Motor 13 is coupled to spindle 5 by means of electrically non-conducting coupling 15. Motor 14 is coupled to pulley 4 by means of electrically non-conducting V-belt 16. The fiber feeding apparatus 16 is positioned so that it is in contact with electrode 8 and its fiber discharge port is aligned with the opening in the side of electrode 8.

In operation, separated fibers 10 are injected by fiber feeder 17 through opening 9 into the electrical field existing between revolving electrode element 1 and stationary electrode 8. The fibers are subsequently formed into a textile strand by the process of Kotter and Salaun, U.S. Pat. No. 3,696,603, which discloses an apparatus in which the electrical field existing between the revolving electrode and the stationary electrode is not disclosed in a direction radial from the revolving electrode and the twisting element. In the apparatus and process of the prior art under some conditions a portion of the fibers injected into the electrical field would tend to pass completely through the field and consequently be lost from the process as the fibers would fly into the surrounding area. On the other hand, the design of stationary electrode 8 enlarges the effective electrical field, without increasing the size of the revolving electrode, thus eliminating or greatly reducing fiber loss. Actual tests show that some operating conditions result in a heavy loss of long fibers when the stationary electrode is flat. When the stationary electrode is bowl-shaped as described herein, the same operating conditions can be used with the loss of only a very small amount of extremely short fibers.

Another benefit of the special design of stationary electrode 8 is that fibers may be injected into the electrical field existing between it and the revolving electrode in a direction parallel to the axis of the electrodes. This would permit the elimination of opening 9 in the side of electrode 8.

The interior surface of stationary electrode 8 comprises the exterior limit of the effective electrical field. This surface may be mathematically described as being generated by rotating a radial line through a 360° angle about an axis. The radial line thus rotated may be described as continuously increasing in separation, in a direction radial from the axis, from a radial line on the surface of revolving electrode element 1. For the apparatus depicted in FIGS. 1 and 2 revolving electrode element 1 is a conical section having an included angle of 160°, having a maximum diameter of 5.875 inches, and having its perimeter rounded to a radius of 0.295 inches. Stationary electrode 8 is positioned so that its axis coincides with the axis of revolving electrode element 1 and its minimum separation from revolving electrode element 1 (at a point about the top edge of electrode element 1 and parallel to the axis) is 1.483 inches. In a direction to the left of the axis the radial line, by which the interior surface of stationary electrode 8 is generated, extends perpendicular to the axis of the electrode to a point where it intersects a radial line defined as a spiral curve generated about the center of curvature of the perimeter of revolving electrode element 1. The spiral curve depicted herein is $R = (1.438 + 0.008329\theta)$ inches when $\theta$ is in degrees. The radial line along the surface of stationary electrode 8 and perpendicular to the axis intersects the spiral curve at a distance of approximately 3.448 inches from the axis which corresponds to approximately $\theta = 110.0°$. From this point the radial line along the surface of the electrode is defined by the spiral curve though $\theta = 211.0°$ at which point the effective electrical field terminates.

The electrodes of the instant invention are not limited either with respect to size or shape provided by the drawings of FIGS. 1 and 2. These serve to illustrate a preferred embodiment. The revolving electrode can have other flat or curved shapes, and the stationary electrode may be any corresponding shape that will provide a continuously increasing distance between the electrodes in a direction radial from the axis of rotation.

FIG. 3 illustrates, in cross section — in a plane through and parallel with the axis — various combinations of electrode surface shapes (including that of FIGS. 1 and 2) which provide radially increasing electrode separation and a substantially enclosed rotatable electrode. The spindle and twisting element are not shown in these illustrations.

Figure 3A:
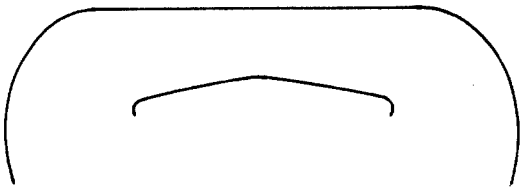
FIG. 3 is a schematic elevation view illustrating, in cross section, several contour combinations of opposing surfaces of the stationary electrode and the revolving electrode (not including the spindle and twisting element).
Figure 3D:
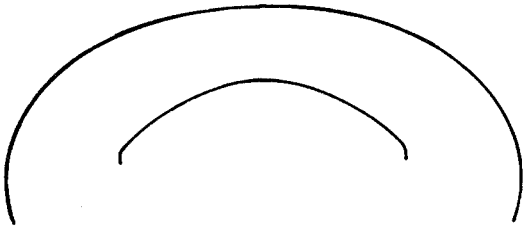
Figure 3B:
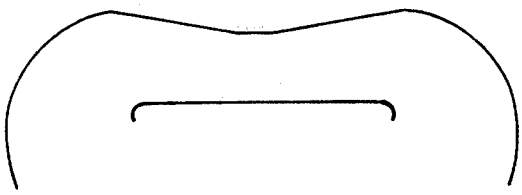
Figure 3E:
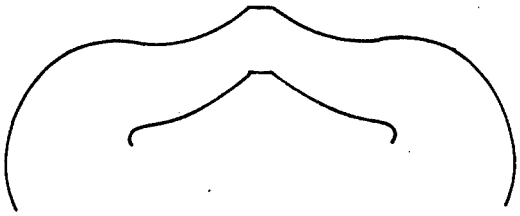
Figure 3C:
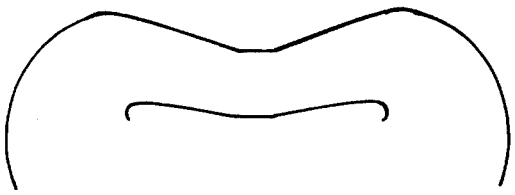
Figure 3F:
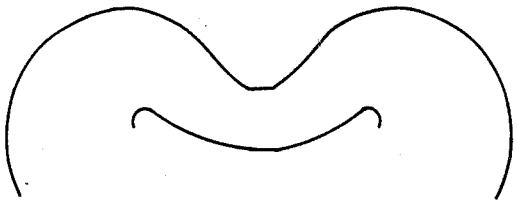

In each set of electrodes the perimeter of the revolving electrode is a convex curve of constant radius and the opposing portion of the surface of the stationary electrode is contoured to a concave spiral curve. In FIG. 3*a* illustrated also in FIG. 1 and 2) the major portion of the revolving electrode surface is a convex cone having straight sides and the opposing surface of the stationary electrode is flat. In FIG. 3*b* the major portion of the revolving electrode surface is flat and the opposing surface of the stationary electrode is a convex cone having straight sides. In FIG. 3*c* the major portion of the revolving electrode surface is a concave cone having straight sides and the opposing surface of the stationary electrode is a convex cone having straight sides and having a smaller included angle. In FIG 3*d* the major portion of the revolving electrode surface is a convex cone having sides convex curved to a constant radius and the opposing surface of the stationary electrode has sides contoured to a concave spiral curve. In FIG. 3*e* the major portion of the revolving electrode surface is a convex cone having sides concave curved to a constant radius and the opposing surface of stationary electrode has sides contoured to a convex spiral curve. In FIG. 3*f* the major portion of the revolving electrode surface is a concave cone having sides concave curved to a constant radius and the opposing surface of the stationary electrode has sides contoured to a convex spiral curve.

In reducing the instant invention to practice the electrodes were machined from solid aluminum block because of ease of fabrication; however, this should not be construed as a limit to the invention with respect to either that material or method of fabrication, since what is of consequence is the configuration of the opposing surfaces of the two electrodes and the electrical conductivity of the opposing surfaces of electrode 8 and electrode element 1.

I claim:

1. In a yarn spinning apparatus of the type comprising a stationary electrode, a rotatable electrode spaced from the stationary electrode and means connected to said electrodes for establishing and maintaining an electrical field between them, and said stationary electrode having an opening axially aligned with the rotatable electrode through which the formed yarn is withdrawn, the improvement characterized by:

a. a stationary electrode which
   1. substantially encloses the rotatable electrode by extending, in a direction parallel to the axis, at least to the plane of the greatest diameter of the rotatable electrode,
   2. has a surface opposing the rotatable electrode which is round in all planes perpendicular to the axis of the rotatable electrode, and
   3. is positioned so that its axis is coincident with the axis of the rotatable electrode, and b. the two electrodes being a corresponding size and shape so that the space between their opposing surfaces increases in a direction radial from their common axis.

2. The improvement in the apparatus of claim 1 wherein the stationary electrode has an opening in its side through which fibers are introduced into the electrical field.

3. The improvement in the apparatus of claim 2 wherein the major portion of the revolving electrode surface is a convex cone having sides concave curved to a constant radius and the opposing surface of the stationary electrode has sides contoured to a convex spiral curve.

4. The improvement in the apparatus of claim 2 wherein the major portion of the revolving electrode surface is a concave cone having sides concave curved to a constant radius annd the opposing surface of the stationary electrode has sides contoured to a convex spiral curve.

5. The improvement in the apparatus of claim 1 wherein the perimeter of the revolving electrode is a convex curve of constant radius and the opposing portion of the surface of the stationary electrode is contoured to a concave spiral curve.

6. The improvement in the apparatus of claim 1 wherein the major portion of the revolving electrode surface is a convex cone having straight sides and the opposing surface of the stationary electrode is flat.

7. The improvement in the apparatus of claim 1 wherein the major portion of the revolving electrode surface is flat and the opposing surface of the stationary electrode is a convex cone having straight sides.

8. The improvement in the apparatus of claim 1 wherein the major portion of the revolving electrode surface is a concave cone having straight sides and the opposing surface of the stationary electrode is a convex cone having straight sides and having a smaller included angle.

9. The improvement in the apparatus of claim 1 wherein the major portion of the revolving electrode surface is a convex cone having sides convex curved to a constant radius and the opposing surface of the stationary electrode has sides contoured to a concave spiral curve.

* * * * *